US010947092B2

(12) United States Patent
Bygrave et al.

(10) Patent No.: US 10,947,092 B2
(45) Date of Patent: Mar. 16, 2021

(54) RAIL FASTENING DEVICE

(71) Applicant: GANTRY RAILING LTD, Gloucestershire (GB)

(72) Inventors: Peter Nathan Bygrave, Gloucestershire (GB); Stephen David Engert, Bristol (GB)

(73) Assignee: GANTRY RAILING LTD.

( * ) Notice: Subject to any disclaimer, the term of this patent is extended or adjusted under 35 U.S.C. 154(b) by 254 days.

(21) Appl. No.: 15/748,178

(22) PCT Filed: Jul. 27, 2016

(86) PCT No.: PCT/GB2016/052302
§ 371 (c)(1),
(2) Date: Jan. 27, 2018

(87) PCT Pub. No.: WO2017/017449
PCT Pub. Date: Feb. 2, 2017

(65) Prior Publication Data

US 2018/0222726 A1 Aug. 9, 2018

(30) Foreign Application Priority Data

Jul. 29, 2015 (GB) ..... 1513369
Jan. 11, 2016 (GB) ..... 1600443

(51) Int. Cl.
*B66C 7/08* (2006.01)
*E01B 9/46* (2006.01)
(Continued)

(52) U.S. Cl.
CPC ..... *B66C 7/08* (2013.01); *E01B 9/42* (2013.01); *E01B 9/44* (2013.01); *E01B 9/46* (2013.01); *E01B 9/66* (2013.01); *E01B 2201/04* (2013.01)

(58) Field of Classification Search
CPC ..... B66C 7/08; E01B 9/42; E01B 9/44; E01B 9/46; E01B 9/66
See application file for complete search history.

(56) References Cited

U.S. PATENT DOCUMENTS 1,911,231 A * 5/1933 Aurelius ..... E01B 9/46 238/304
3,784,097 A * 1/1974 Landis ..... E01B 9/46 238/310

(Continued)

FOREIGN PATENT DOCUMENTS

AT 7942 U2 11/2005
CA 1088480 A 10/1980

(Continued)

OTHER PUBLICATIONS

U.K. Intellectual Property Office, GB Application No. GB 1600443.4, "Search Report under Section 17" Claims searched: 1-20, Jun. 24, 2016, 1 page.

(Continued)

*Primary Examiner* — Jason C Smith
(74) *Attorney, Agent, or Firm* — Kang S. Lim

(57) ABSTRACT

A rail fastening device (100) comprises a lower plate (11) and an upper plate (12) provided with a pair of clips (13) for engaging the rail 16, the upper plate (12) being fastened to the lower plate (11) by a pair of fastening bolts (19) which extend through respective apertures (20) in the upper plate (12), the fastening bolts (19) being slidably mounted to the lower plate (11) for movement in a direction which, in use, extends transverse the rail (16). A jacking bolt (31) is arranged to lift the upper plate away from the lower plate as the bolt (31) is tightened and vice-versa. An alignment bolt extends 33 laterally between the upper and lower plates (11), (12) and is rotatable to displace the upper plate (12) laterally relative to the lower plate (11). A levelling bolt (102)

(Continued)

threadably engaged with the lower plate is arranged to lift the lower plate (11) away from the surface on which the device (100) is seated as the bolt (102) is tightened and vice-versa.

17 Claims, 6 Drawing Sheets

(51) Int. Cl.
*E01B 9/42* (2006.01)
*E01B 9/44* (2006.01)
*E01B 9/66* (2006.01)

(56) References Cited

U.S. PATENT DOCUMENTS

| | | | | |
|---|---|---|---|---|
| 3,858,804 | A * | 1/1975 | Hixson | E01B 9/02 238/264 |
| 3,904,113 | A * | 9/1975 | Molyneux | B66C 7/08 238/264 |
| 4,561,589 | A * | 12/1985 | Hixson | E01B 9/66 238/297 |
| 10,132,044 | B2 * | 11/2018 | Couvreur | B66C 7/08 |
| 2016/0002864 | A1 * | 1/2016 | Awi Abalo | E01B 9/46 238/297 |
| 2018/0222726 | A1 * | 8/2018 | Bygrave | E01B 9/42 |

FOREIGN PATENT DOCUMENTS

| | | | |
|---|---|---|---|
| CN | 200995930 | Y | 12/2007 |
| CN | 202543737 | U | 11/2012 |
| CN | 203639759 | U | 6/2014 |
| CN | 103979410 | A | 8/2014 |
| DE | 102004050175 | B3 | 12/2005 |
| FR | 2832432 | A1 | 5/2003 |
| GB | 1586028 | A | 3/1981 |
| JP | 2008069513 | A | 3/2008 |
| KR | 2020090003979 | U | 4/2009 |
| SU | 1506004 | A1 | 9/1989 |
| WO | WO2014/124935 | | 8/2014 |

OTHER PUBLICATIONS

U.K. Intellectual Property Office, GB Application No. GB 1600443.4, "Search Report under Section 17" Claims searched: 21-28, Jun. 24, 2016, 2 pages.

U.K. Intellectual Property Office, GB Application No. GB 1600443.4, "Search Report under Section 17" Claims searched: 29-37, Jun. 20, 2016, 3 pages.

U.K. Intellectual Property Office, GB Application No. GB 1600443.4, "Search Report under Section 17" Claims searched: 38-47, Jun. 20, 2016, 2 pages.

European Patent Office, "Invitation to Pay Additional Fees And, Where Applicable, Protest Fee," in PCT Application No. PCT/GB2016/052302, dated Oct. 28, 2016, 6 pages.

U.K. Intellectual Property Office, GB Application No. GB 1600443.4, "Search Report under Section 17" Search Report cover sheet, dated Jun. 27, 2016, 2 pages.

National Intellectual Property Administration, PRC (CNIPA), "CN first Office Action Notice of Invention Application" in CN Application No. 201680054527.X , dated Mar. 5, 2019 , 14 pages.

* cited by examiner

RAIL FASTENING DEVICE

CROSS-REFERENCE TO RELATED APPLICATIONS

The present application is a United States National Stage entry under 35 U.S.C. § 371 of International Application No. PCT/GB2016/052302 filed Jul. 27, 2016, designating the United States of America and published in English on Feb. 2, 2017, which in turn claims priority to Great Britain Application Nos. 1513369.7, filed on Jul. 29, 2015 and 1600443.4, filed on Jan. 11, 2016, all of which are incorporated herein by reference in their entirety.

The present invention relates to a rail fastening device and more particularly but not solely to a device for fastening a rail on which a wheeled crane runs to the ground.

Cranes which run on rails are well known in dockyards and container ports for lifting and transporting objects from one place to another. Typically, such rails are laid on elongate concrete beams, the rails being fixed to the beams generally at intervals of 500 to 900 mm by rail fastening devices. Typically, each device comprises a plate provided with a pair of rail clips which engage flanges on respective opposite sides of the rail. The plate is secured with two anchor bolts to fix the device to the beam. The lateral position of the rail is set by the position of the rail fastening devices. Once the precise final level of the rail is achieved during installation, a layer of non-shrink high strength grout is placed between the plate and the concrete beam.

With ever increasing demands for space to build new or expand container ports, reclaiming land has become commonplace but a problem with this is that the foundations of crane rails can move as the ground settles. Clearly, maintaining the lateral and vertical positions of crane rails is crucial to allow cranes to operate correctly and safely.

Whilst, the vertical position of the rail can be adjusted during installation it cannot be thereafter without disturbing the anchor bolts and damaging the grout.

It will be appreciated that the lateral position of the rail can only be adjusted to the extent of the rail fastening devices which is invariably only a small distance.

WO2014/124935 discloses a rail fastening device which attempts to overcome the above problems and comprises a lower plate and an upper plate provided with a pair of rail clips which engage flanges on respective opposite sides of the rail. The lower plate is provided with through holes for anchoring the lower plate to the beam by means of anchoring bolts. The upper plate comprises a pair of laterally elongated first holes (which are distinct from the through holes) for removably securing the upper plate to the lower plate by a first set of bolts independent of the anchoring bolts. The upper plate and the rail clips comprise a pair of corresponding second holes (which are distinct from the first holes and the through holes) for securing the rail clips to the upper plate by means of a second set of bolts which are independent of the first set of bolts and the anchoring bolts.

In use, the first set of bolts are loosened to allow the upper plate to slide laterally relative to the lower plate by virtue of the elongated holes. The upper plate is also free to move vertically. The anchor bolts thus do not need to be loosened and the risk of disturbing the fixing is avoided. However, when using shims between the upper and lower plates, it is important that the shims completely underlie the upper plate to provide adequate support. This means that the shims must also be provided with laterally elongated slots or holes to allow the shims to move together with the upper plate, thereby ensuring that the upper plate remains fully supported.

The lateral forces applied to the upper plate when a crane moves along the rail are considerable and a disadvantage of the clip of WO2014/124935 is that the first set of bolts are not constrained against lateral forces where they pass through the elongated slots in the shims. Thus there is a risk that the bolts will bend laterally in the slots, particularly if the height of the shims is considerable, with the result that the upper plate can slip laterally with respect to the lower plate.

We have now devised an improved rail fastening device.

In accordance with the present invention, as seen from a first aspect, there is provided a rail fastening device comprising a lower plate and an upper plate provided with a pair of clips for engaging the rail, wherein the upper plate is fastened to the lower plate by a pair of fastening bolts which extend through respective apertures in the upper plate, the fastening bolts being slightly mounted to the lower plate for movement in a direction which, in use, extends transverse the rail.

In use, in order to move the upper plate, the fastening bolts are loosened to allow the height of the upper plate to be adjusted by inserting or removing shims from between the two plates: the fastening bolts also slide to allow the lateral position of the upper plate relative to the lower plate to be adjusted. Since the fastening bolts themselves move when the lateral position of the upper plate is adjusted, there is no need to provide elongated apertures in the shims, which simply move together with the fastening bolts and therefore always underlie the upper plate. In this manner, the fastening bolts are laterally constrained by the shims and the risk of the fastening bolts bending is avoided.

The rail fastening device of the present invention is also more compact than that of the device of WO2014/124935 because it uses one bolt as opposed to two on each side of the rail.

Each fastening bolt may be slidably mounted in a slot formed in the lower plate.

Each fastening bolt may be journalled in the slot in which it is mounted.

Each fastening bolt may be removable from its slot.

Each fastening bolt may comprise an enlarged head, which may be T-shaped in section for example, which is captively and slidably received in the slot.

A cover may be provided for closing each slot to prevent the ingress of fluid and to keep the slot clear of debris.

The covers may slide with the fastening bolts and may comprise an aperture through which the fastening bolt extends.

The slots may be formed adjacent respective opposite end edges of the lower plate.

The slots may be bounded by drainage channels, which may have open ends at the end edges of the lower plate to allow water or other fluids to flow out of the channels.

The covers may extend over the channels, the channels serving to trap any water or other fluids which may leak around the edges of the covers.

The apertures in the upper plate may comprise slots formed in respective opposite end edges of the upper plate, so as to allow the fastening bolts to be removed from the device without removing the upper plate.

The clips may be detachably mounted to the upper plate by respective said fastening bolts. The clips help to lock the upper end of the fastening bolts in position, so that they cannot slip unlike the first set of bolts of the device of WO2014/124935.

The clips may be slidably mounted to the upper plate by respective said fastening bolts.

The clips may comprise an abutment surface on their underside which engages a complementary abutment surface on the top side of the upper plate. In this manner any forces applied to the clips are applied to the upper plate and not to the fastening bolts.

When a lateral load is applied from the rail, the load transfer passes into the rail clip top part. The design of the rail clips means that as the load is applied to the upper part it translates along an angled slot. However, the wedge shape of the upper and lower parts of the clip cause a locking effect so the clip only moves a fraction.

The clips may be arranged to move downwardly towards the upper plate to constrain the rail as they are slid towards each other. This action means that the tension in the fastening bolts is increased as the clips move apart, which in turn increases the clamp load and friction between the parts. The greater the load, the greater the locking effect.

One or more shims may be disposed between the upper and lower plates, the shims being provided with apertures through which the respective fastening bolts extend.

In order to allow shims to be added or removed without removing the upper plate, the apertures in the shims may comprise slots which extend from a side edge of the shim and which, in use, extend longitudinally of the rail. The orientation of the slots still constrain the fastening bolts against the risk of lateral bending in a direction which generally extends perpendicular to the rail.

Once installed, regular surveys at specified intervals will determine whether the crane rail system is outside of operational tolerances. This will identify any areas of the rail that need vertical or lateral adjustment.

If the foundation of the rail settles and the level of the rail falls outside of the operational tolerances required by the cranes, the fastening bolts can be loosened and the position of the upper plate can be adjusted both vertically and laterally to bring the rail back within operational tolerance.

Hitherto, the vertical position of the rail is adjusted using secondary jacking devices, which are engaged with the rail and then adjusted to bring the rail to the desired level before inserting shims between the upper and lower plates. Such secondary jacking devices are expensive and difficult to transport. Furthermore, many such secondary devices may be required to level a substantial length of rail.

Thus, in accordance with the present invention, as seen from a second aspect, there is provided a rail fastening device comprising a lower plate and an upper plate fastenable to the lower plate, wherein a jacking bolt threadably engaged with the upper plate has a lower end which abuts the upper surface of the lower plate, the jacking bolt being arranged to lift the upper plate away from the lower plate as the bolt is tightened and vice-versa.

In this manner, each rail fastening device effectively comprises its own jack which can be used to bring the rail to the correct level without the need for expensive secondary jacking devices.

The jacking bolt may be removable once the level has been set. In time, the level of the rail may need to be adjusted again and this can be simply achieved by inserting an inexpensive jacking bolt of the appropriate length and thread.

Over time there is a risk that the thread in the upper plate may become corroded. In order to overcome this problem, the upper plate may comprise a formation against which a nut can act in a manner where it is prevented from rotation, the jacking bolt then being engaged with the nut. The nut and the jacking bolt can then be removed once the level has been set. The formation may comprise a recess into which the nut can be captively inserted.

The rail fastening device may comprise a pair of such jacking bolts on respective opposite sides of the rail.

The rail fastening device in accordance with the first aspect of the invention may include the features of the rail fastening device in accordance with the second aspect of the invention.

Considerable forces may need to be applied to adjust the lateral position of the rail.

Thus, in accordance with the present invention, as seen from a third aspect, there is provided a rail fastening device comprising a lower plate and an upper plate fastenable to the lower plate, wherein an alignment bolt extends laterally between the upper and lower plates substantially in the plane thereof, the bolt being rotatable to provide a force between the upper and lower plates which acts to displace the upper plate laterally relative to the lower plate.

In this manner each rail fastening device comprises its own realignment mechanism, which can be used to bring the rail to the correct lateral position.

The realignment bolt may be removable once the lateral position of the rail has been set.

The realignment bolt may be threadably engaged with the lower plate, the bolt comprising an inner end which abuts the side of the upper plate, the realignment bolt being arranged to push the upper plate as the realignment bolt is tightened.

In time, the lateral position of the rail may need to be adjusted again and this can be simply achieved by inserting an inexpensive realignment bolt of the appropriate length and thread.

Over time, there is a risk that the thread in the lower plate may become corroded. In order to overcome this problem, the lower plate comprises a formation against which a nut can act in a manner where it is prevented from rotation, the realignment bolt then being engaged with the nut. The nut and the realignment bolt can then be removed once the level has been set. The formation may comprise a recess into which the nut can be captively inserted.

The rail fastening device may comprise a pair of such realignment bolts or formations on respective opposite sides of the rail for moving the rail in respective opposite lateral directions.

The rail fastening device in accordance with the first and/or second aspects of the invention may include the features of the rail fastening device in accordance with the third aspect of the invention.

It is important that the final level of the rail is precisely achieved during installation before the layer of non-shrink high strength grout is placed between the lower plate and the concrete beam. It is therefore necessary to adjust the vertical position of the lower plate.

Thus, in accordance with the present invention, as seen from a fourth aspect, there is provided a rail fastening device comprising a lower plate and an upper plate fastenable to the lower plate, wherein a levelling bolt threadably engaged with the lower plate has a lower end arranged to abut a surface on which the device is seated, the levelling bolt being arranged to lift the lower plate away from a surface on which the device is seated as the bolt is tightened and vice-versa.

In this manner, each rail fastening device effectively comprises its own jack which can be used to bring the rail to the correct level before grout is placed between the lower plate and the concrete beam or other support surface on which the device is seated.

The levelling bolt may be removable once the level has been set.

The lower plate may comprise a formation against which a nut can act in a manner where it is prevented from rotation, the levelling bolt then being engaged with the nut. The levelling bolt can then be removed once the level has been set. The formation may comprise a recess into which the nut can be captively inserted.

The rail fastening device may comprise a pair of such levelling bolts on respective opposite sides of the rail, for example at diametrically opposed corners of the lower plate.

The rail fastening device in accordance with the first, second and/or third aspects of the invention may include the features of the rail fastening device in accordance with the fourth aspect of the invention.

Embodiments of the present invention will now be described by way of examples only and with reference to the accompanying drawings, in which.

Figure 1:
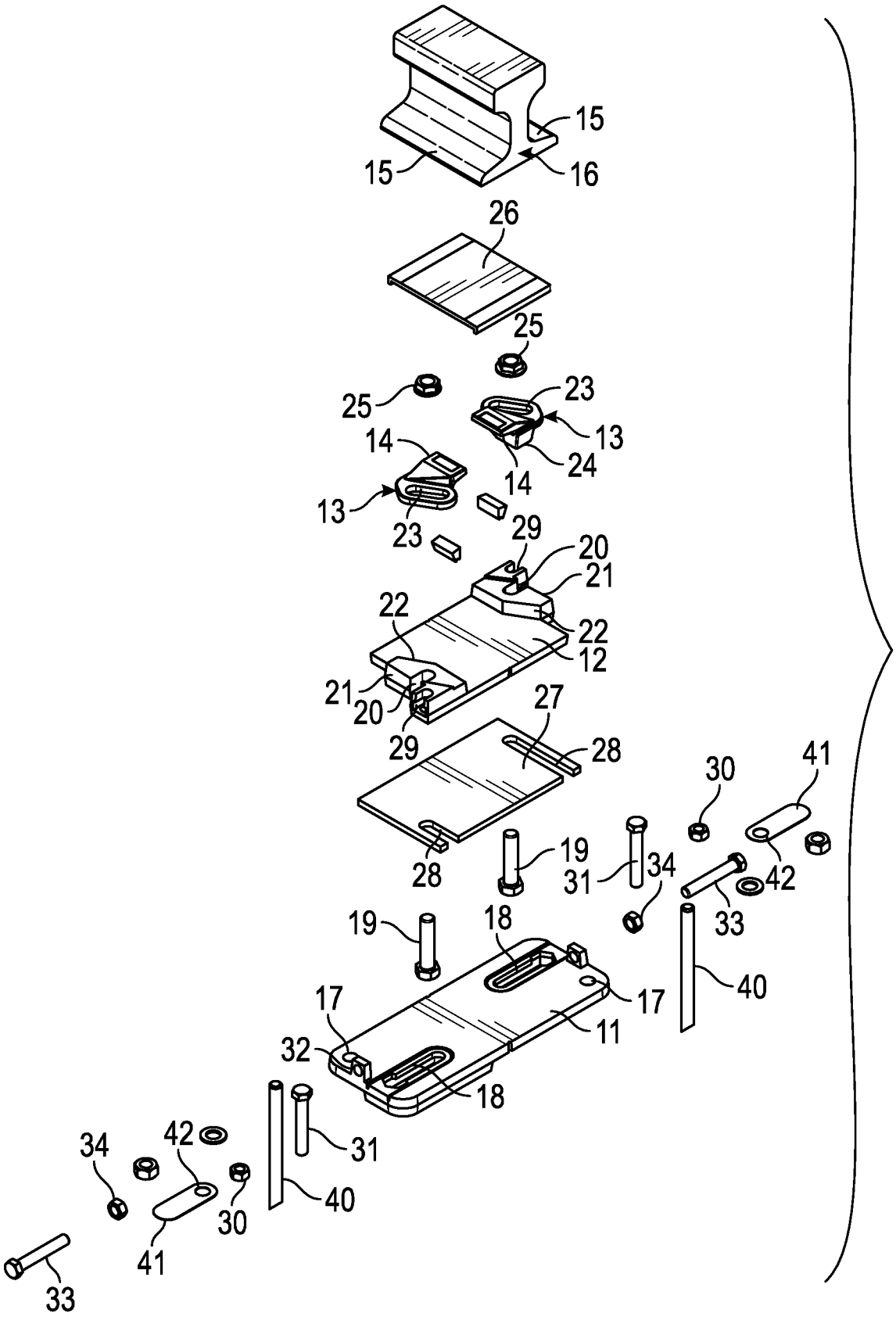
FIG. 1 is an exploded view of an embodiment of rail fastening device in accordance with the present invention.
Figure 2:
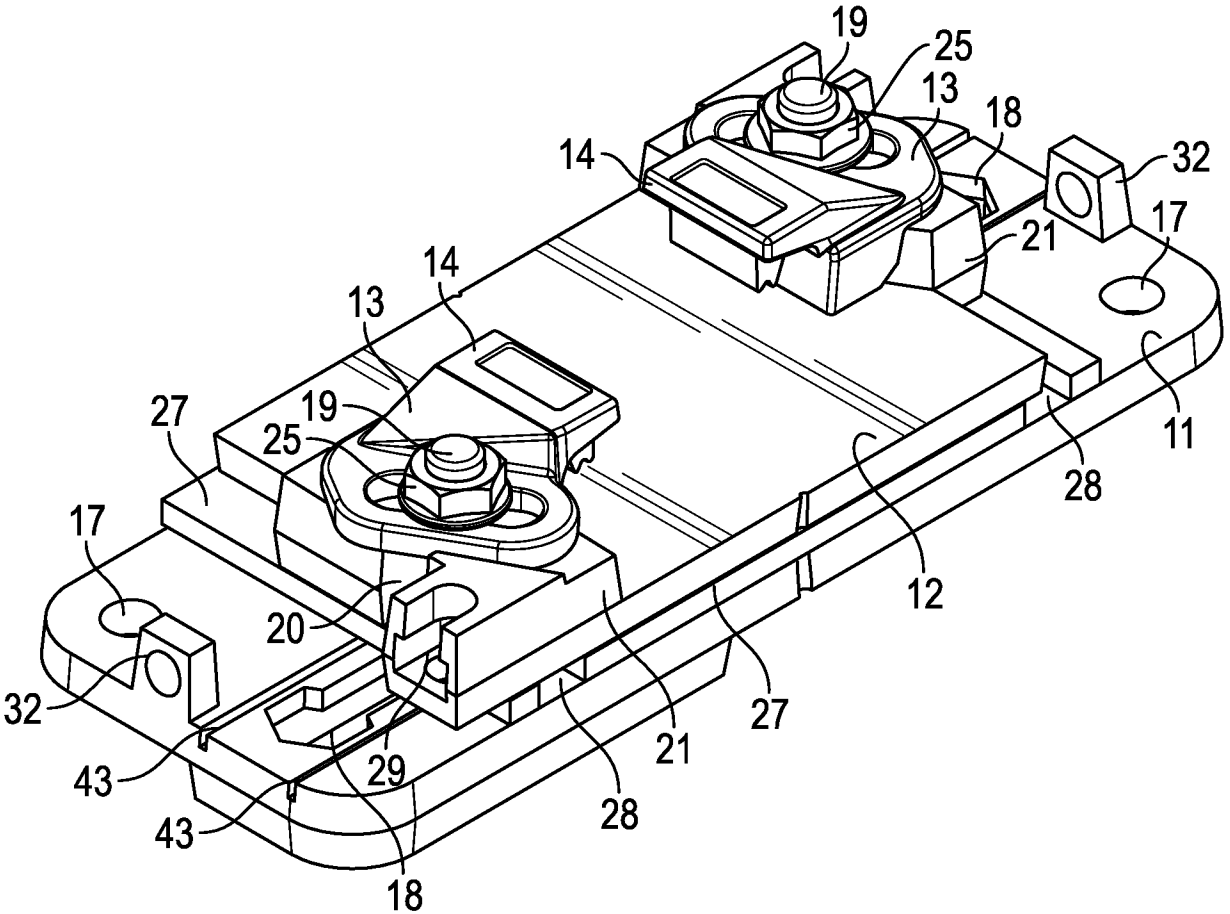
FIG. 2 is a perspective side view from one end and above of the rail fastening device of FIG. 1.
Figure 3:
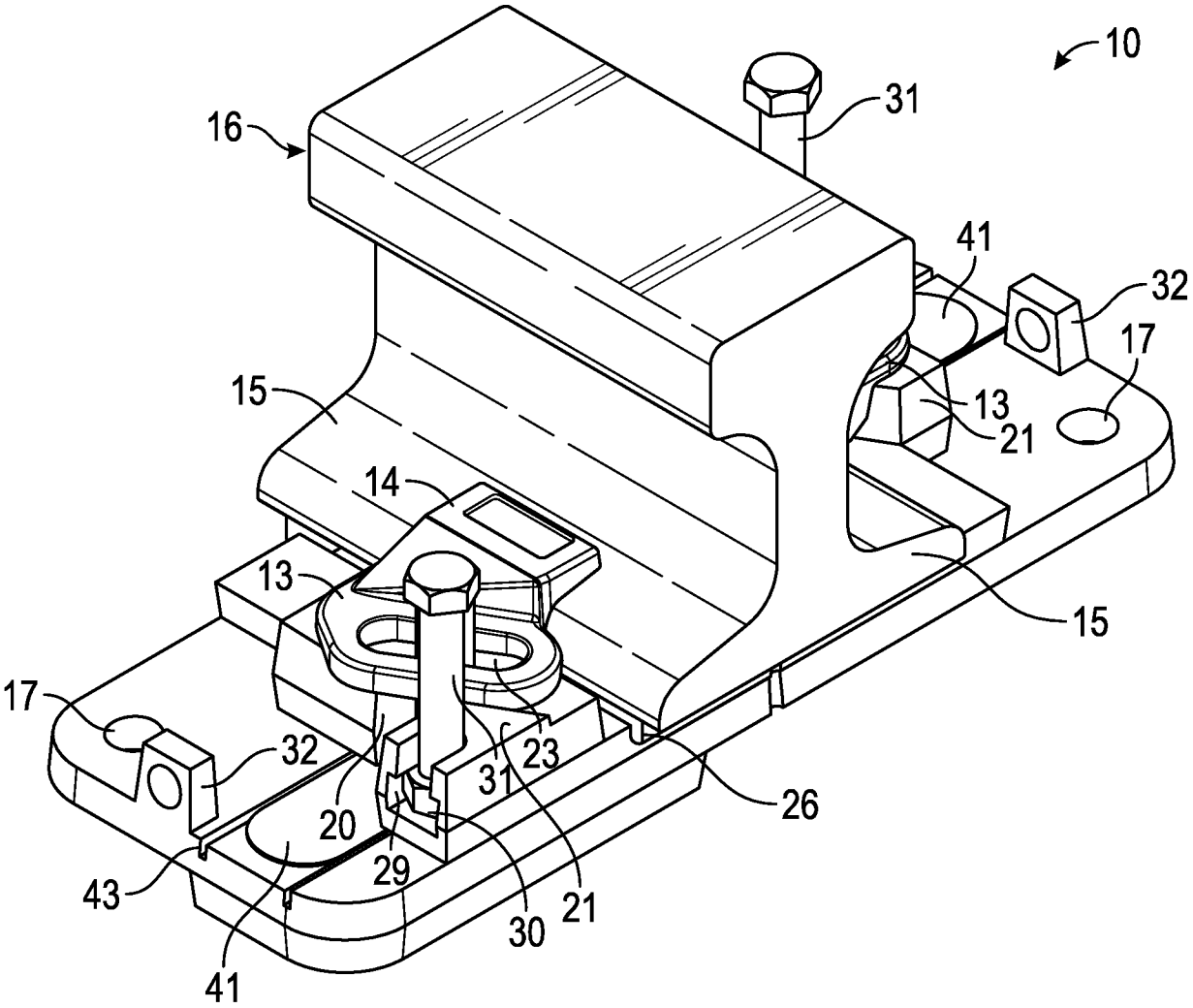
FIG. 3 is a perspective side view from one end and above of the rail fastening device of FIG. 1, illustrating the second aspect of the invention.
Figure 4:
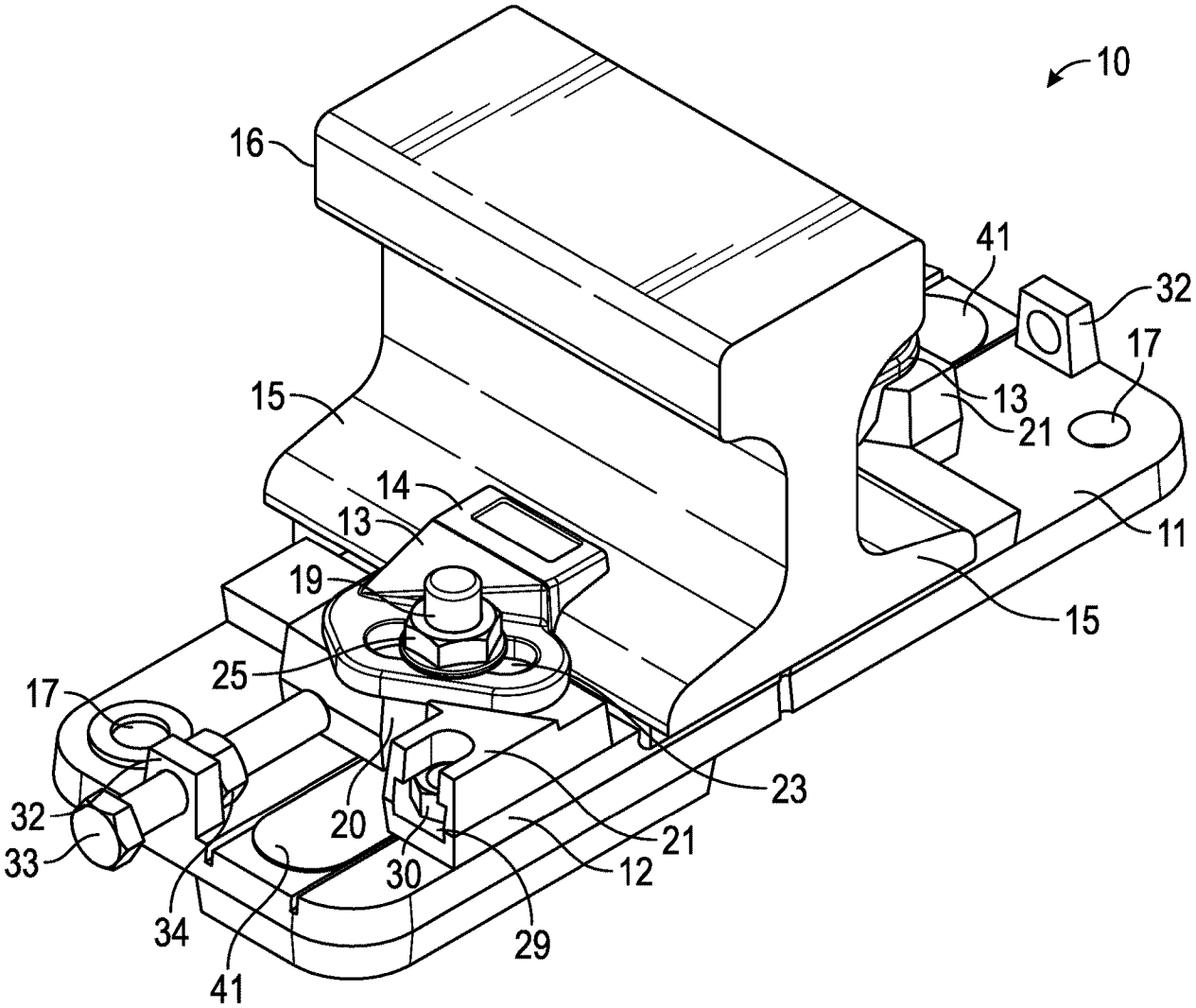
FIG. 4 is a perspective side view from one end and above of the rail fastening device of FIG. 1, illustrating the third aspect of the invention.

Referring to FIGS. 1 to 4 the drawings, there is shown a rail fastening device 10 comprising a rectangular lower plate 11 and a rectangular upper plate 12. A pair of rail clips 13 are provided on the upper surface of the upper plate 12 at opposite ends thereof. The rail clips 13 each comprise an inwardly-directed nose 14 that engages over a lip 15 on the respective opposite sides of a rail 16.

The lower plate 11 comprises a pair of holes 17, through which ground anchoring bolts 40 pass. A pair of laterally-extending slots 18 are formed at opposite ends of the upper surface of the lower plate 11. The slots 18 each comprise an elongate inner end region which is an inverted T-shape in section. The outer ends of the slots 18 are enlarged to allow the hexagonal heads of respective fastening bolts 19 to be inserted into the slots 18 and slid inwardly to a position where they are captively constrained. The underside of the lower plate 11 may be provided with formations to help key the lower plate with the grout on which it is set.

A cover plate 41 is provided for closing each slot 18 to prevent the ingress of fluid and to keep the slot 18 clear of debris. The covers 41 comprise an aperture 42 through which the fastening bolt 19 extends, so that the covers 41 slide with the fastening bolts 19. The slots 18 are bounded by drainage channels 43, which have open ends at the end edges of the lower plate 11 to allow fluid to flow out of the channels. The covers 41 extend over the channels 43, the channels 43 serving to trap any fluid which may leak around the edges of the covers 41.

The upper plate 12 comprises a pair of cut-outs 20 in its respective opposite ends, through which the fastening bolts 19 extend. The upper plate 12 also comprises a pair of enlarged upper surface formations 21 at its respective opposite ends, which define seats for the respective rail clips 13 and comprise inwardly-facing abutment surfaces 22 which are angled at approximately 30° to the longitudinal axis of the rail 16. The rail clips 13 comprise elongate apertures 23, through which respective fastening bolts 19 extend. The underside of each rail clip 13 comprises an enlarged lower surface formation 24 having an inclined outwardly-facing abutment surface which slidably engages with the abutment surface 22. The clips 13 can thus be moved towards the rail 16 by sliding them forwardly and sideways at an angle of 30°. The clips are supported on the upper plate 12 in such a way that they also move downwardly as they are slid towards the rail 16. The abutment surfaces ensure that any lateral forces applied to the clips 13 are applied to the upper plate and not to the fastening bolts 19.

Once the rail 16 is correctly in-situ, nuts 25 on the upper ends of the fastening bolts 19 are tightened to secure the clips 13 and the upper plate 12 to the lower plate 11. A rail pad 26 may be disposed between the rail 16 and the fastening device 10. Also, one or more shims 27 may be disposed between the upper plate 12 and the lower plate 11 to bring the rail 16 to the correct vertical level. The shims 27 comprise a pair of slots 28 in one of their side edges, which allow the shims 27 to be slid axially of the rail 16 into position, with the slots 28 serving to receive the respective fastening bolts 19.

The enlarged formations 21 at opposite ends of the upper plate 12 comprise recesses 29, which are of an inverted T-shape in section. Over time, the vertical position of the rail 16 may need to be adjusted, for example due to subsidence of the foundations on which the rail fastening devices 10 are laid. In order to achieve this, hexagonal nuts 30 are inserted into the recesses 29. Jacking bolts 31 are then engaged with the nuts 30 and screwed downwardly until their lower ends abut the upper surface of the lower plate 11. The nuts 25 holding the clips 13 and upper plate 12 to the lower plate 11 can then be loosened or removed. The jacking bolts 31 can then be tightened to raise the upper plate 12 away from the lower plate 11 to bring the rail 16 to the desired height. Additional shims 27 can then be inserted between the upper plate 12 and the lower plate 11 before the nuts 25 are re-applied and tightened. In the event that the fastening bolts 19 are of insufficient length, the cut-outs 20 allow the bolts 19 to be removed and replaced with longer bolts. Of course, if the level of the rail 16 needs to be lowered, the jacking bolts 31 can be used to lift the upper plate 12 to allow shims 27 to be removed before the upper plate 12 is lowered. Once the new position of the rail 16 has been set and the nuts 25 tightened, the jacking bolts 31 and the nuts 30 can be removed to avoid the risk of corrosion of any of the threads.

The lower plate 11 comprises a pair of apertured formations 32 at its respective opposite ends. In order to laterally align the rail 16, a realignment bolt 33 is passed through an apertured formation 32 on the lower plate 11. The axis of the realignment bolt 33 extends parallel to the plane of the upper and lower plates 11, 12. If, for example, the rail 16 needs to be moved to the right in the drawings, the realignment bolt 33 only needs to be inserted into the left hand apertured formation 32. Once in-situ, a nut 34 is threaded into the distal end of the realignment bolt 33 and the bolt is tightened until the nut 34 abuts the inner face of the apertured formation 32, with the upper surface of the lower plate 11 serving to prevent rotation of the nut 34 as the realignment bolt 33 is tightened.

The nuts 25 can then be loosened before the realignment bolt 33 is further tightened until its distal end abuts the end face of the upper plate 12. It will be appreciated that further tightening of the realignment bolt 33 acts to push the upper plate (and hence the rail 16) into a new position. Once at the correct position, the nuts 25 can be re-applied and tightened before the realignment bolt 33 and nut 34 is removed.

Figure 5:
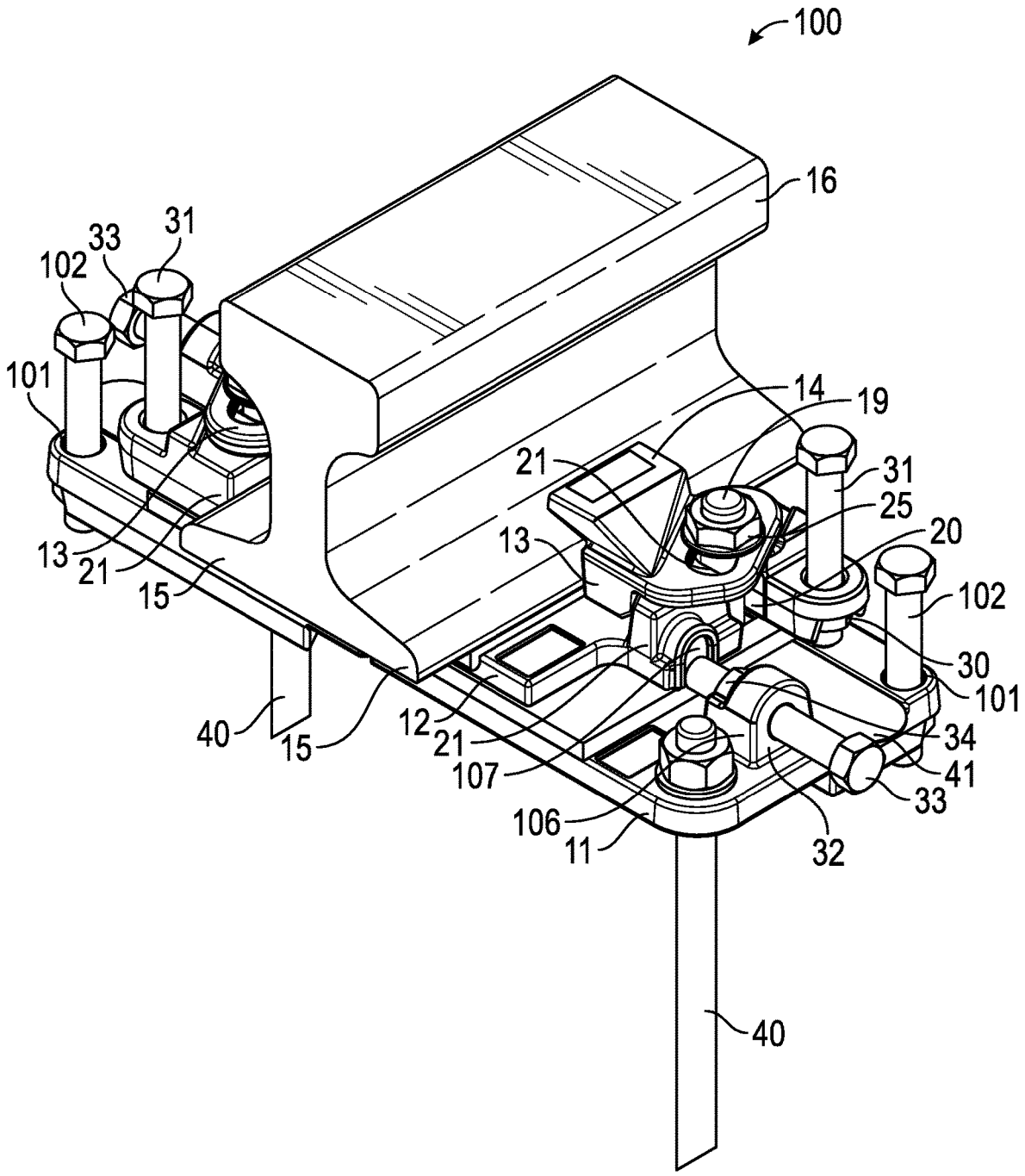
FIG. 5 is a perspective side view from one end and above of an alternative embodiment of rail fastening device in accordance with the present invention.
Figure 6:
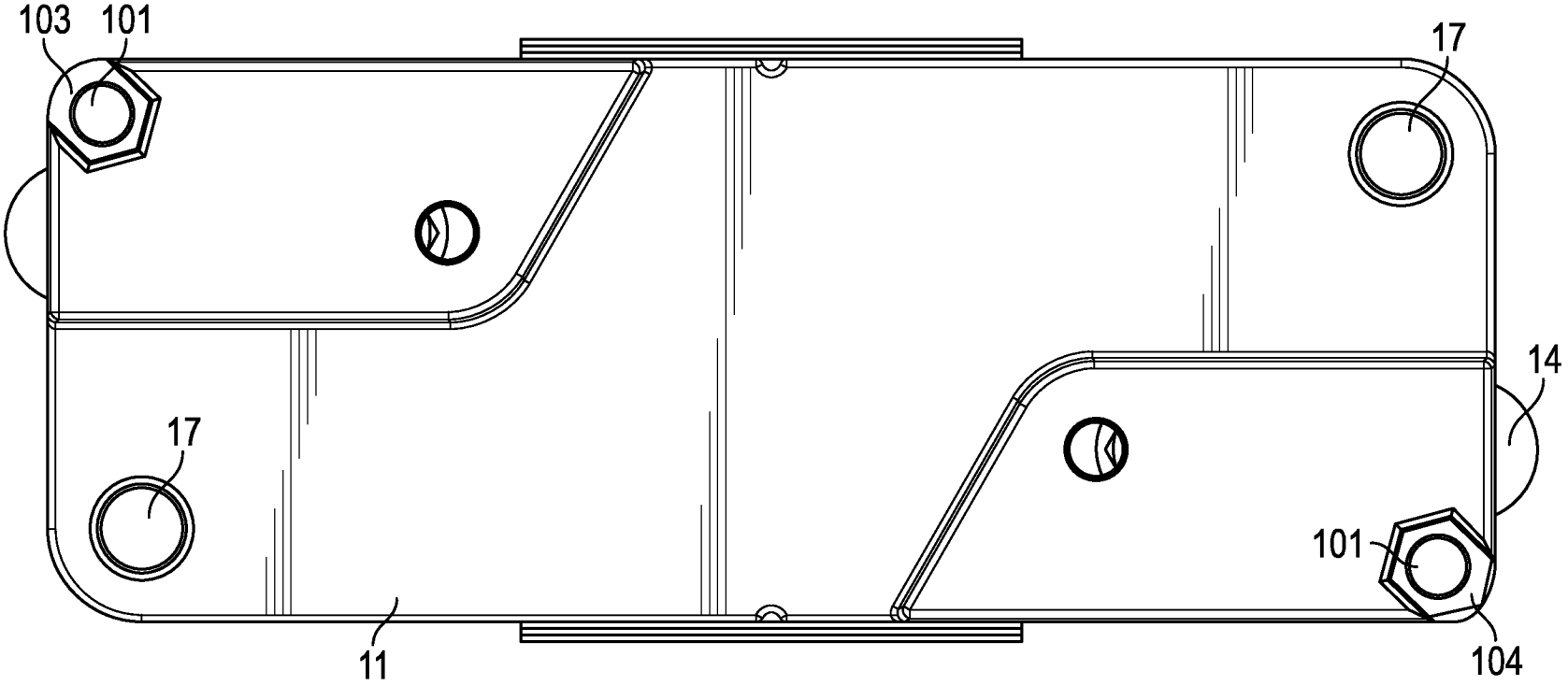
FIG. 6 is a bottom view of the rail fastening device of FIG. 5.

Referring to FIGS. 5 and 6 of the drawings, there is shown an alternative embodiment of rail fastening device 100 which is similar in construction to the rail fastening device 10 of FIGS. 1 to 4 and like parts are given like reference numerals.

In this embodiment, each end of the lower plate 11 also comprises a pair of holes 101, through which levelling bolts 102 can pass. The bolts 102 engage with nuts 104 which are removably disposed in hexagonal recesses 103 formed in the underside of the lower plate 11 at respective diagonally opposed corners thereof. During installation of the device 100, the bolts 102 can be engaged with the nuts 104 and adjusted to set the lower plate 11 at the desired level before grout is placed between the lower plate 11 and the concrete beam or other surface on which the device 100 is seated. The levelling bolts 102 can then be removed and the holes filled or plugged to avoid the risk of corrosion Each apertured formation 32 comprises a formation 106 on its inner face in which the nut 34 seats. The formations 106 prevent rotation of the nut 34 as the realignment bolt 33 is tightened. The distal end of the realignment bolt 33 is abuts a recess 107 formed in the end face of the upper plate 12.

A rail fastening device in accordance with the present invention is able to reliably and securely hold a rail, yet provides improved ways of vertically and laterally realigning the rail if necessary.

The invention claimed is:

1. A rail fastening device comprising a lower plate, an upper plate and a pair of clips for engaging the rail to be fastened, wherein the upper plate is fastened to the lower plate by a pair of fastening bolts which extend through respective apertures in the upper plate, the fastening bolts being slidably mounted to the lower plate for movement in a direction which, in use, extends transverse the rail, wherein the clips are slidably mounted to the upper plate by respective said fastening bolts, and a jacking bolt is threadably engaged with the upper plate and has a lower end which abuts the upper surface of the lower plate, the jacking bolt being arranged to lift the upper plate away from the lower plate as the bolt is tightened and vice-versa.

2. A rail fastening device as claimed in claim 1, in which each fastening bolt comprises an enlarged head which is captively and slidably received in a slot formed in the lower plate.

3. A rail fastening device as claimed in claim 1, in which a cover is provided for closing each slot.

4. A rail fastening device as claimed in claim 1, in which the clips are detachably mounted to the upper plate by respective said fastening bolts.

5. A rail fastening device as claimed in claim 1, in which the clips comprise an abutment surface on their underside which engages a complementary abutment surface on the top side of the upper plate.

6. A rail fastening device as claimed in claim 1, in which an alignment bolt extends laterally between the upper and lower plates substantially in the plane thereof, the bolt being rotatable to provide a force between the upper and lower plates which acts to displace the upper plate laterally relative to the lower plate.

7. A rail fastening device as claimed in claim 1, in which a levelling bolt threadably engaged with the lower plate has a lower end arranged to abut a surface on which the device is seated, the levelling bolt being arranged to lift the lower plate away from a surface on which the device is seated as the bolt is tightened and vice-versa.

8. A rail fastening device comprising a lower plate and an upper plate fastenable to the lower plate, wherein a jacking bolt threadably engaged with the upper plate has a lower end which abuts the upper surface of the lower plate, the jacking bolt being arranged to lift the upper plate away from the lower plate as the bolt is tightened and vice-versa.

9. A rail fastening device as claimed in claim 8, in which the rail fastening device comprises a pair of jacking bolts on respective opposite sides of the rail.

10. A rail fastening device as claimed in claim 8, in which an alignment bolt extends laterally between the upper and lower plates substantially in the plane thereof, the bolt being rotatable to provide a force between the upper and lower plates which acts to displace the upper plate laterally relative to the lower plate.

11. A rail fastening device as claimed in claim 8, in which a levelling bolt threadably engaged with the lower plate has a lower end arranged to abut a surface on which the device is seated, the levelling bolt being arranged to lift the lower plate away from a surface on which the device is seated as the bolt is tightened and vice-versa.

12. A rail fastening device comprising a lower plate and an upper plate fastenable to the lower plate, wherein an alignment bolt extends laterally between the upper and lower plates substantially in the plane thereof, the bolt being rotatable to provide a force between the upper and lower plates which acts to displace the upper plate laterally relative to the lower plate.

13. A rail fastening device as claimed in claim 12, in which the fastening device comprises a pair of alignment bolts on respective opposite sides of the rail for moving the rail in respective opposite lateral directions.

14. A rail fastening device as claimed in claim 13, in which a levelling bolt threadably engaged with the lower plate has a lower end arranged to abut a surface on which the device is seated, the levelling bolt being arranged to lift the lower plate away from a surface on which the device is seated as the bolt is tightened and vice-versa.

15. A rail fastening device comprising a lower plate and an upper plate fastenable to the lower plate, wherein a levelling bolt threadably engaged with the lower plate has a lower end arranged to abut a surface on which the device is seated, the levelling bolt being arranged to lift the lower plate away from a surface on which the device is seated as the bolt is tightened and vice-versa.

16. A rail fastening device as claimed in claim 15, in which the rail fastening device comprises a pair of levelling bolts on respective opposite sides of the rail.

17. A rail fastening device as claimed in claim 16, in which the levelling bolts are disposed on respective opposite sides of the rail at diametrically opposed corners of the lower plate.

* * * * *